US008986039B2

(12) United States Patent
Harlan et al.

(10) Patent No.: US 8,986,039 B2
(45) Date of Patent: Mar. 24, 2015

(54) SHELF LIGHTING CONNECTOR ASSEMBLY

(71) Applicant: Phoenix Contact Development & Manufacturing, Inc., Middletown, PA (US)

(72) Inventors: Tod M. Harlan, Mechanicsburg, PA (US); Osenaga Osagie, Harrisburg, PA (US); Nathan Potteiger, Middletown, PA (US); Kevin Walker, Hershey, PA (US)

(73) Assignee: Phoenix Contact Development and Manufacturing, Inc., Middletown, PA (US)

( * ) Notice: Subject to any disclaimer, the term of this patent is extended or adjusted under 35 U.S.C. 154(b) by 14 days.

(21) Appl. No.: 14/018,541

(22) Filed: Sep. 5, 2013

(65) Prior Publication Data

US 2014/0235093 A1 Aug. 21, 2014

Related U.S. Application Data

(60) Provisional application No. 61/766,154, filed on Feb. 19, 2013.

(51) Int. Cl.

| | |
|---|---|
| ***H01R 13/658*** | (2011.01) |
| ***H01R 13/73*** | (2006.01) |
| ***A47F 11/10*** | (2006.01) |
| ***H01R 25/14*** | (2006.01) |
| ***A47B 97/00*** | (2006.01) |
| *F21V 33/00* | (2006.01) |
| *H01R 13/24* | (2006.01) |
| *H01R 13/62* | (2006.01) |
| *F21W 131/301* | (2006.01) |

(52) U.S. Cl.

CPC ..... *H01R 13/73* (2013.01); *A47F 11/10* (2013.01); *H01R 25/142* (2013.01); *A47B 97/00* (2013.01); *F21V 33/0012* (2013.01); *H01R 13/2421* (2013.01); *H01R 13/6205* (2013.01); *F21W 2131/301* (2013.01); *A47B 2220/0077* (2013.01)

USPC ..... 439/370

(58) Field of Classification Search

CPC ..... H01R 13/73

USPC ..... 439/370; 362/125, 133, 390

See application file for complete search history.

(56) References Cited

U.S. PATENT DOCUMENTS 5,348,485 A 9/1994 Briechle et al.
6,791,466 B1 * 9/2004 Chang et al. ..... 340/4.21

(Continued)

FOREIGN PATENT DOCUMENTS

DE 10 2007 028395 A1 12/2008
DE 20 2012 008355 U1 10/2012

(Continued)

OTHER PUBLICATIONS

European Patent Office, European Search Report in corresponding European Patent Application No. 14 000 554.7, Jun. 5, 2014, 6 pages.

(Continued)

*Primary Examiner* — Phuongchi T Nguyen
(74) *Attorney, Agent, or Firm* — Hooker & Habib, P.C.

(57) ABSTRACT

A shelf lighting connector assembly provides an electrical connection between a power strip on a wall and a light mounted on the underside of a shelf mounted on the wall.

18 Claims, 7 Drawing Sheets

(56) References Cited

U.S. PATENT DOCUMENTS

| | | | | |
|---|---|---|---|---|
| 6,835,075 | B2 * | 12/2004 | Truggelmann | 439/110 |
| 7,766,502 | B2 | 8/2010 | Tress | |
| 8,348,211 | B2 * | 1/2013 | Bauer | 248/245 |
| 8,376,302 | B2 * | 2/2013 | Bauer et al. | 248/317 |
| 8,646,935 | B2 * | 2/2014 | Karan | 362/125 |
| 2003/0038571 | A1 * | 2/2003 | Obrock et al. | 312/408 |
| 2006/0209537 | A1 | 9/2006 | Stelmasik et al. | |
| 2008/0043456 | A1 | 2/2008 | Bernardini et al. | |
| 2011/0204009 | A1 | 8/2011 | Karan | |

FOREIGN PATENT DOCUMENTS

| | | |
|---|---|---|
| JP | 2010158337 | 7/2010 |
| JP | 2012040334 | 3/2012 |
| KR | 1020070106298 | 11/2007 |

OTHER PUBLICATIONS

SloanLED Apr. 19, 2012 disclosure.

* cited by examiner

SHELF LIGHTING CONNECTOR ASSEMBLY

SUMMARY OF THE DISCLOSURE

The disclosure relates to an improved shelf lighting connector assembly for providing electric power to lights behind the front lips of shelves mounted on a wall. The shelves display products, typically products offered for sale in retail stores.

The assembly includes a power unit removably mounted on the inner lip of each shelf at the wall. Each power unit includes a power cord extending along the underside of the shelf to a light at the outer lip of the shelf and a pair of contacts below the inner shelf lip.

A power strip on the wall behind the shelves includes two side-by-side conductors. The power unit contacts engage the power strip conductors to provide power for the lights. The power units are magnetically mounted on the underside of the shelves at the inner lips and engage the inner lips to assure pressure electrical connections with the conductors. The shelves are located at desired vertical spacing, depending upon marketing requirements. The power units are mounted on the shelves independent of shelf height. The power units are located under the shelves out of sight and with the power cords extending along the ends of the shelves to form concealed power connections for the lights. The conductors in the power strip are connected to a power cord leading to a power supply on the wall. A shield overlies connections between the power cord and the conductors on the strip conductor.

DESCRIPTION OF THE PREFERRED EMBODIMENT

Figure 1:
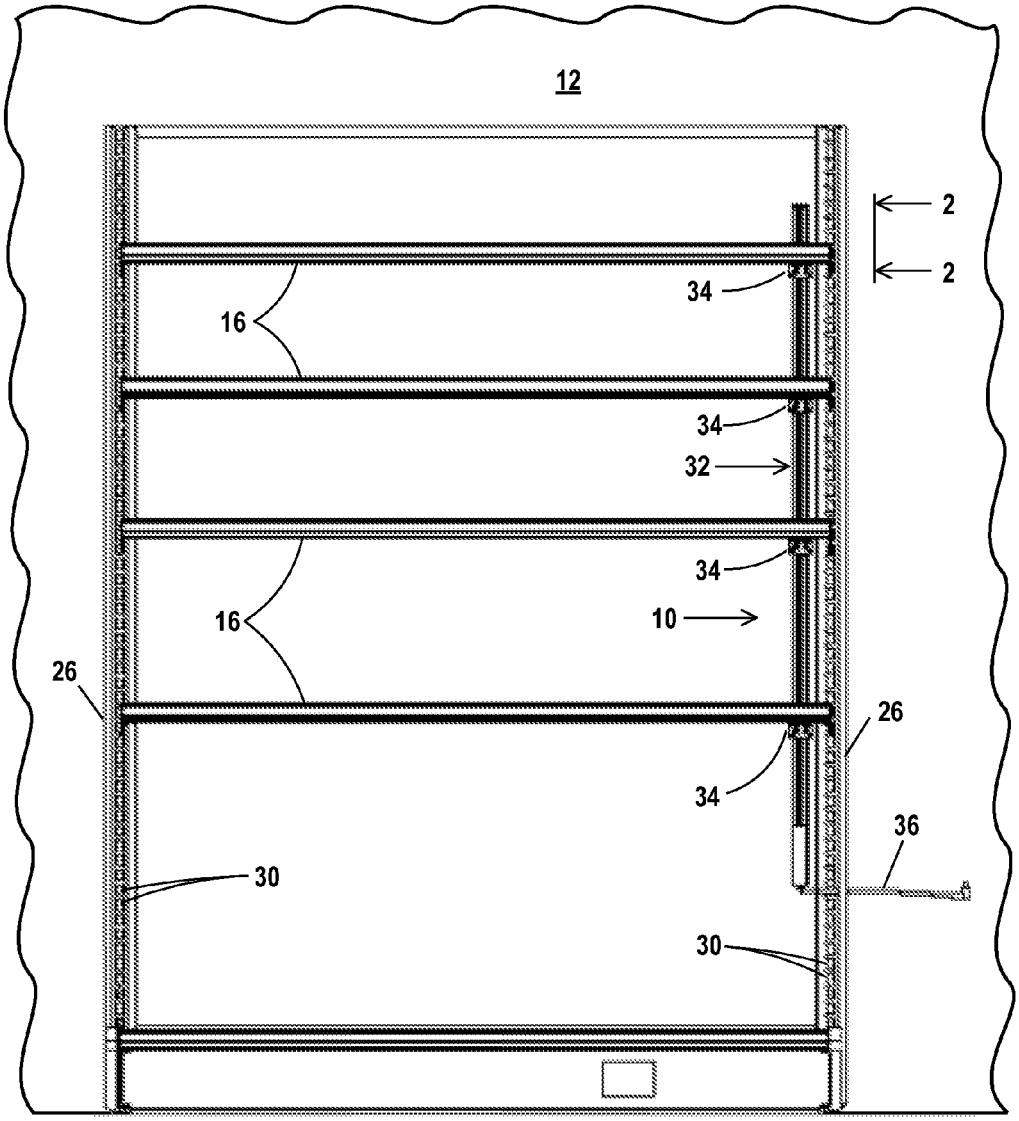
FIG. 1 is a front view of a number of shelves on a wall and a shelf lighting connector assembly on the shelves and wall.

FIG. 1 illustrates shelf lighting connector assembly 10 mounted on vertical wall 12 for forming electrical connections between a power source on the wall (not illustrated) and lights 14 on shelves 16 mounted on wall 12.

Each shelf 16 is made from sheet steel and includes a flat support platform 18 and downwardly bent outer lip 20 and inner lip 22. Mounting brackets 24 are attached to the ends of each shelf. Two spaced vertical strips 26 are secured to wall 12. The shelves are mounted on the wall by extending hooks 28 on mounting brackets 24 into openings 30 in strips 26. Openings 30 are spaced along the lengths of strips 26 to facilitate mounting shelves 16 at desired heights on wall 12.

An elongate light 14 is mounted on the bottom of each shelf support platform 18 adjacent outer lip 20 and extends along the shelf to illuminate the space under the shelf. The lights 14 have power contact sockets on at least one end of the shelves.

Assembly 10 includes a power strip 32 vertically mounted on wall 12 at the end of shelves 16 adjacent the contact sockets for the lights and a power unit 34 mounted on the inner lip 22 of each shelf and engaging the power strip 32. A power cord 36 extends from the lower end of the power strip to the power source.

Each power unit 34 includes a molded plastic body 38 mounted on the underside of a shelf at the inner lip 22. Power cable 40 extends from body 38 under the shelf, along the adjacent end of the shelf and to an end connector 42 adjacent the outer shelf lip 20 for power connection to the contact socket on the light 14 mounted on the bottom of the shelf at the outer lip.

Body 38 includes a lower slide housing 44 and an upper U-shaped support hoop or bracket 46 above housing 44. Hoop 46 has two vertical sidewalls 48 extending up from the sides of housing 44 and a horizontal mounting wall 50 joining the tops of the sidewalls. Magnet recess or slot 52 is formed in the upper surface of mounting wall 50. One or more magnets 54 are secured in recess 52.

Two like contact slide bodies 56 are positioned side-by-side in channels 58 in housing 44. The slide bodies are molded from thermoplastic resin. Each slide body 56 carries a pin contact 60 extending from the rear end of the body. The contacts are attached to leads 62 in the power cable 40 extending from the front end of the body to end connector 42 for engaging the light 14 mounted on the front of the shelf. Coil springs 70 surround the pin contacts 60 and leads 62 and bias the slide bodies 56 toward power strip 32. One end of each coil spring 70 extends into a recess 74 in the slide body. The other spring end 76 engages the bottom of channel 58. See FIG. 6.

The slide assemblies 78 are inserted into the channels 58 from the rear of the body 38. Each body 56 includes a latch arm 64 which is deflected by stop bar 66 on body 38 during insertion and then snaps behind the bar 66 to secure the assembly in the channel while permitting compression of spring 70 and sliding movement in the channel.

Vertical wall 80 extends up from the rear of housing 44 and is spaced a distance back from the housing to form a slot 82 to permit mounting of unit 34 on inner shelf lip 22. Lip 22 extends into slot 82. Inward projection 84 on the top of wall 80 forms a lip retention groove 86 in wall 80. The projection 84 extends into recess 85 in inner shelf lip 22 to locate unit 34 on the shelf.

Figure 3:
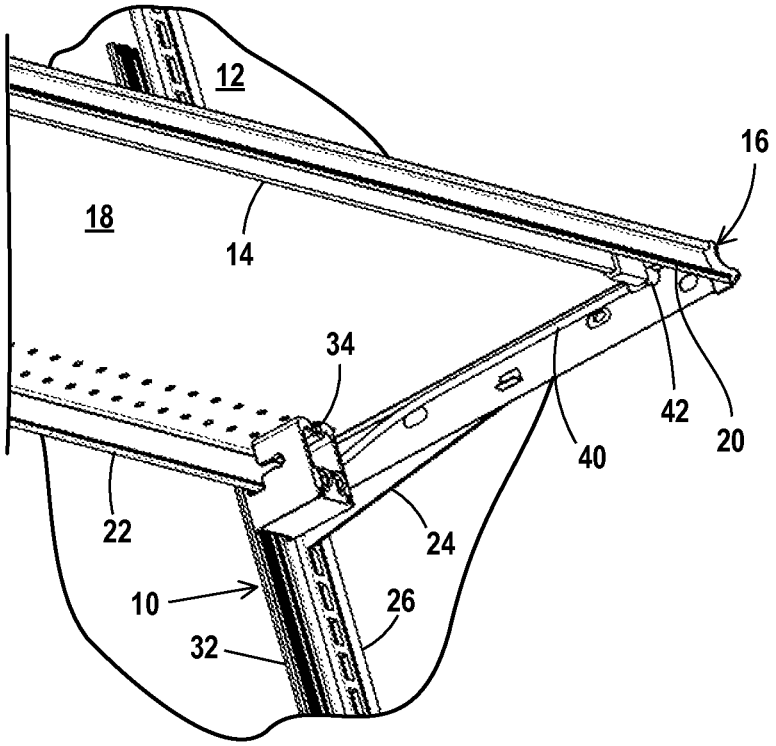
FIG. 3 is an upward perspective view illustrating the bottom of a shelf mounted on the wall.
Figure 4:
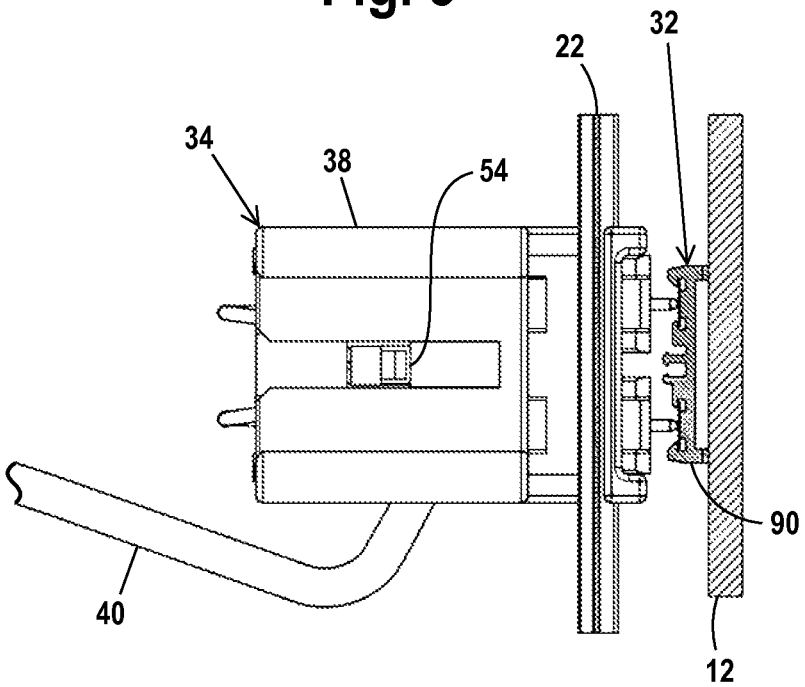
FIG. 4 is a top view of a portion of FIG. 2, partially broken away.
Figure 5:
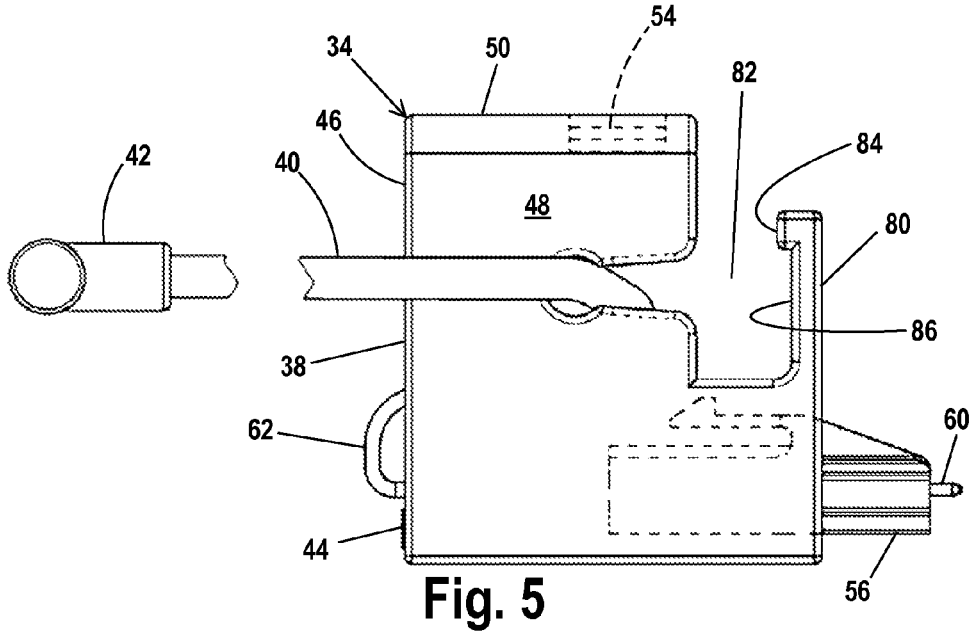
FIG. 5 is a side view of a power unit.
Figure 6:
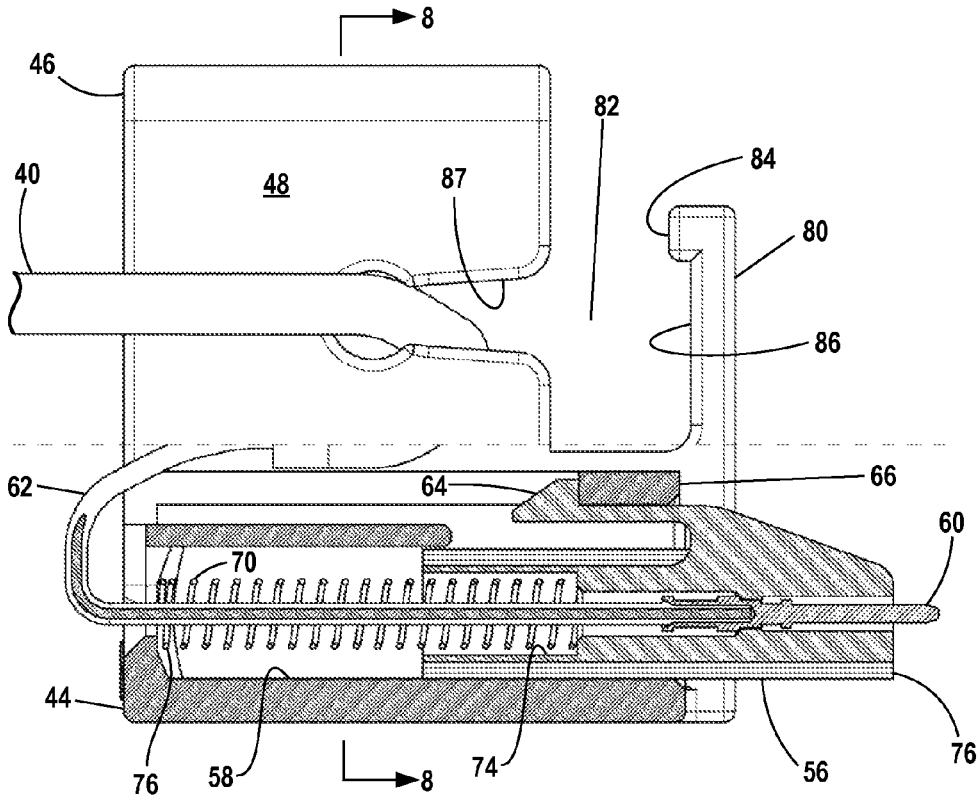
FIG. 6 is a partial sectional side view of the power unit.
Figure 7:
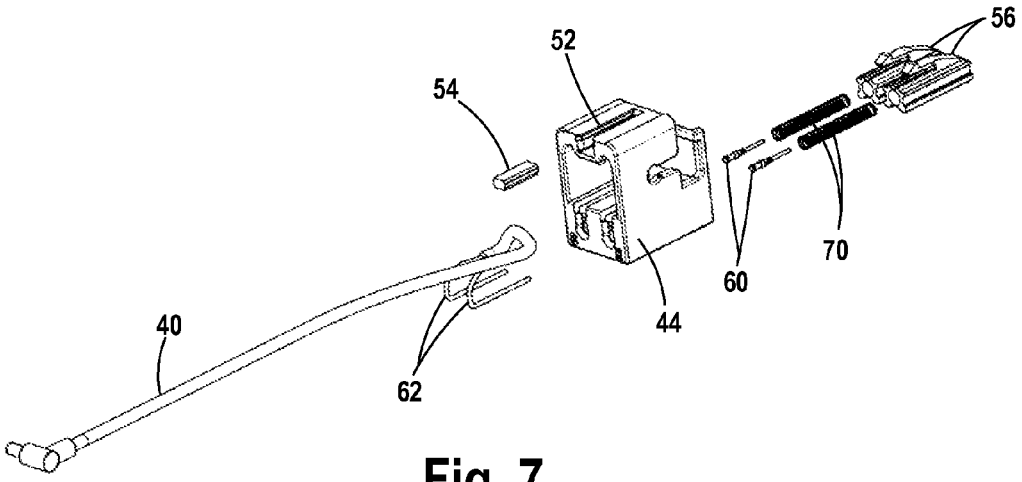
FIG. 7 is an exploded view of the power unit.
Figure 8:
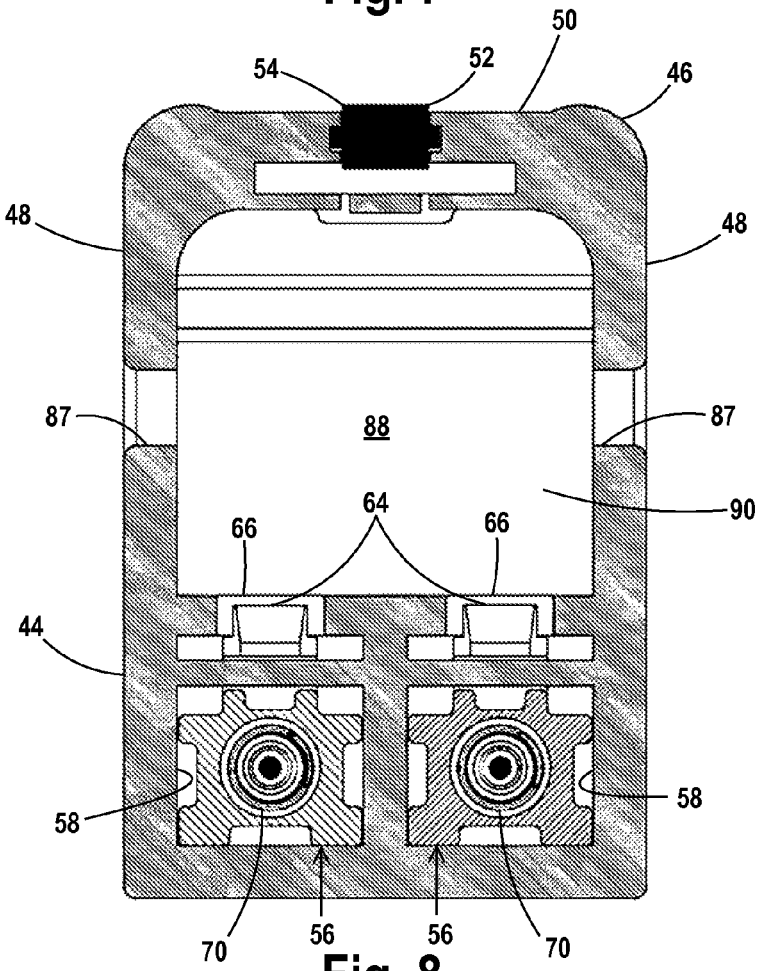
FIG. 8 is a sectional view taken along line 8-8 of FIG. 6.

A cable retention groove 87 is formed in each sidewall 48. The two grooves 87 open into slot 82. Power cables 40 are secured to units 34 with leads 62 joined to pins 60, as illustrated in FIG. 6 and with the leads extending into the opening 88 under hoop 46 and to the inner end of cable 40. The cable 40 is locked into one of the two grooves 87, depending upon which sidewall is adjacent an end bracket 24. Cable 40 is preferably routed along the inner wall of the adjacent mounting bracket 24, as illustrated in FIG. 3. Flexible leads 62 extend from the end of the cable 40 located in opening 88. Cable 40 is relatively inflexible. The individual leads 62 flex and permit movement of the slide bodies in channels 58 without movement of cable 40.

Power strip 32 includes an elongate, flat base 90 extruded from stiffly flexible thermoplastic material. The base has an uniform transverse cross-section. Base 90 is adhesively mounted on wall 12 inwardly from one end of shelves 16.

Figure 11:
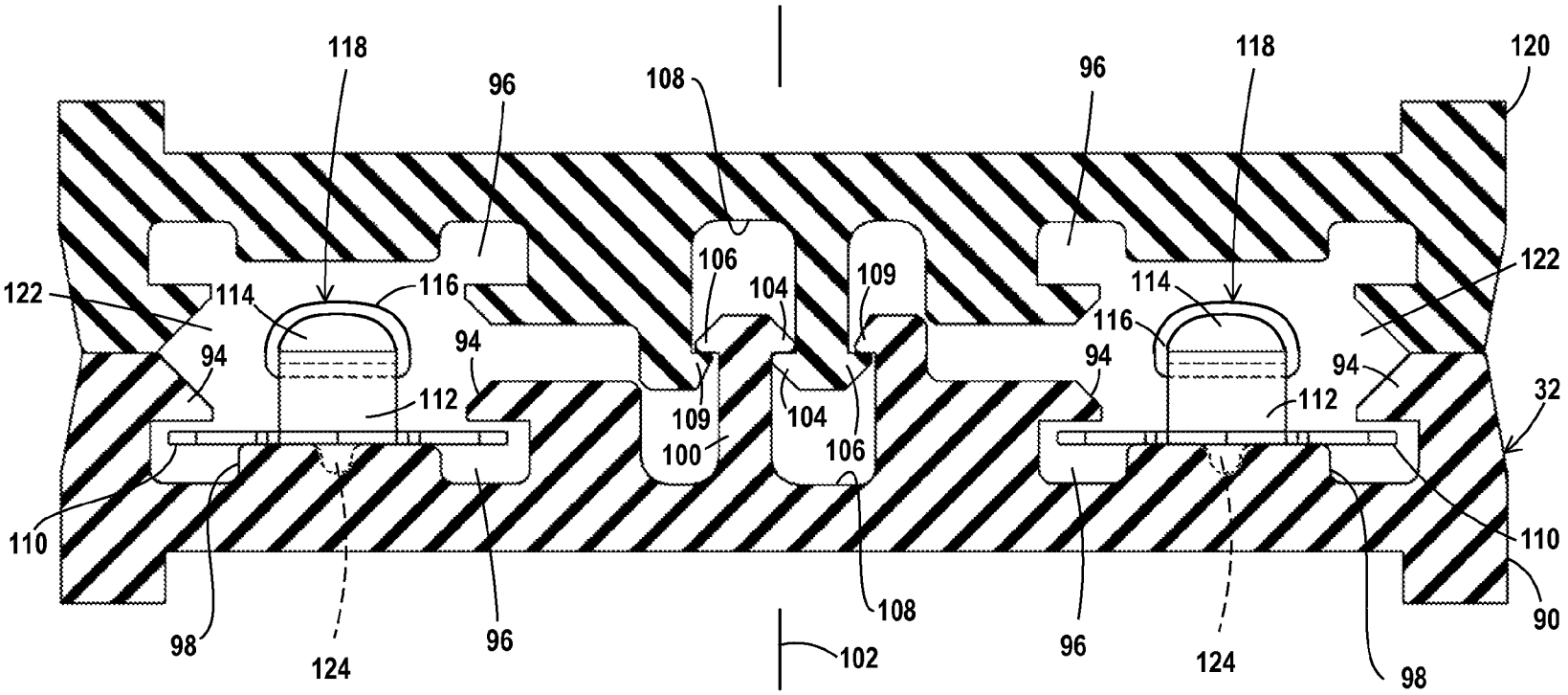
FIG. 11 is a sectional view taken along line 11-11 of FIG. 9.

The base is shown in FIG. 11 and includes a pair of spaced conductor latches 94 extending along each side of base 90. Each pair of latches overlies a strip conductor recess 96 extending along the length of the base. A conductor support 98 extends up from the bottom of each recess 96, between latches 94.

Generally T-shaped locking rib 100 extends up from base 90 to one side of central plane 102. Plane 102 is located equidistant between the sides of the base. Rib 100 includes a latch member 104 extending across plane 102 and a latch member 106 away from the plane. Rib 100 is located in a recess 108 having sidewalls to either side of the central plane 102. Latch member 109 extends from the recess sidewall across plane 102 from adjacent latch member 104 on rib 100.

Figure 10:
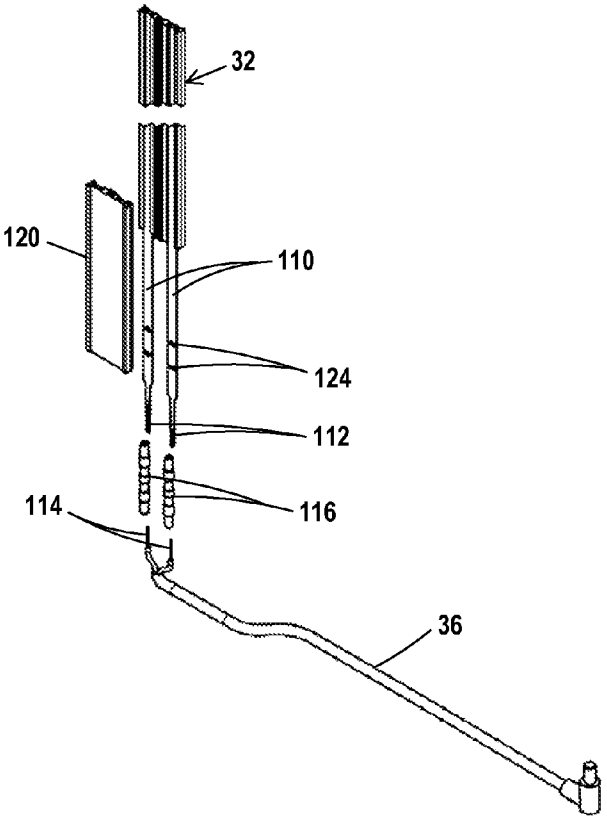
FIG. 10 is an exploded view of a power strip assembly.
Figure 9:
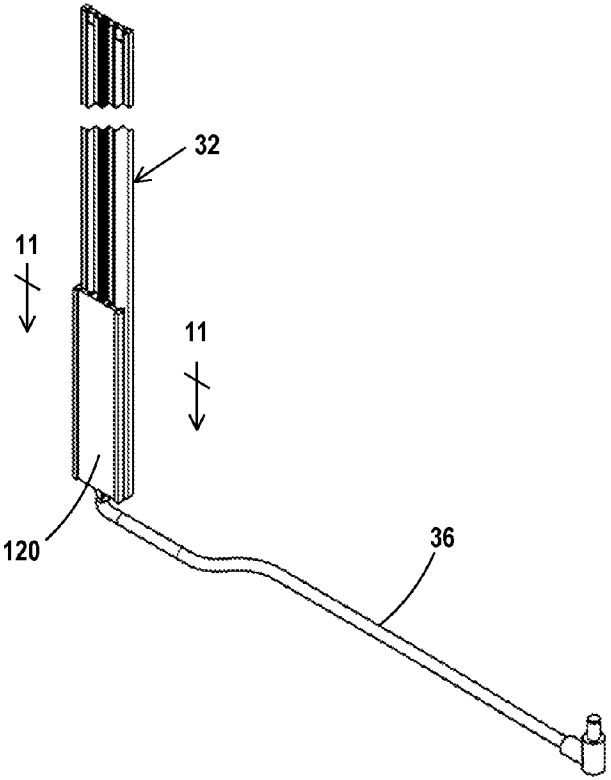
FIG. 9 is a perspective view of a power strip assembly.

Elongate metal conductor strips 110 are fitted in strip conductor recesses 96 and extend along the length of strip 32. See FIGS. 10 and 11. The width of conductors 110 is reduced at the lower ends to form narrow tails 112. Electrical connections are formed between tails 112 and the individual conductors 114 of cord 36 by positioning the conductors and the tails in heat-shrink solder sleeves 116 and then heating the sleeves to melt solder in the sleeves, shrink the sleeves and form reliable solder connections 118 between the tails and conductors. The connections 118 between the conductors and strips have a greater thickness than conductors 110. See FIG. 11.

A shield 120, formed from a length of base 90, is fitted on the lower end of base 90 and overlies the solder connections 118. See FIG. 11. The solder connections 118 extend above base 90 and are each located in a cavity 122 formed by two overlying strip conductor recesses 96 in the base and shield.

The shield is positioned over the solder connections on the lower end of the power strip and then moved toward the strip to latch to the base by inter-engagement between latch members 104 and latch members 106 and 109 on the base and shield as shown in FIG. 11. Latch members 104 on the two adjacent ribs 100 flex and engage each other at central plane 102. The two pairs of latch members 106 and 109 flex and engage each other on opposite sides of the central plane.

The strip conductors 110 are held in place in the base by cut-out tabs 124 which are bent down and extend into bases 98. Two opposing tabs 128 are provided in each conductor 110.

If desired, additional shields, like shield 120, may be mounted on base 90 between shelves 16 to prevent accidental contact with strip conductors 110.

Figure 2:
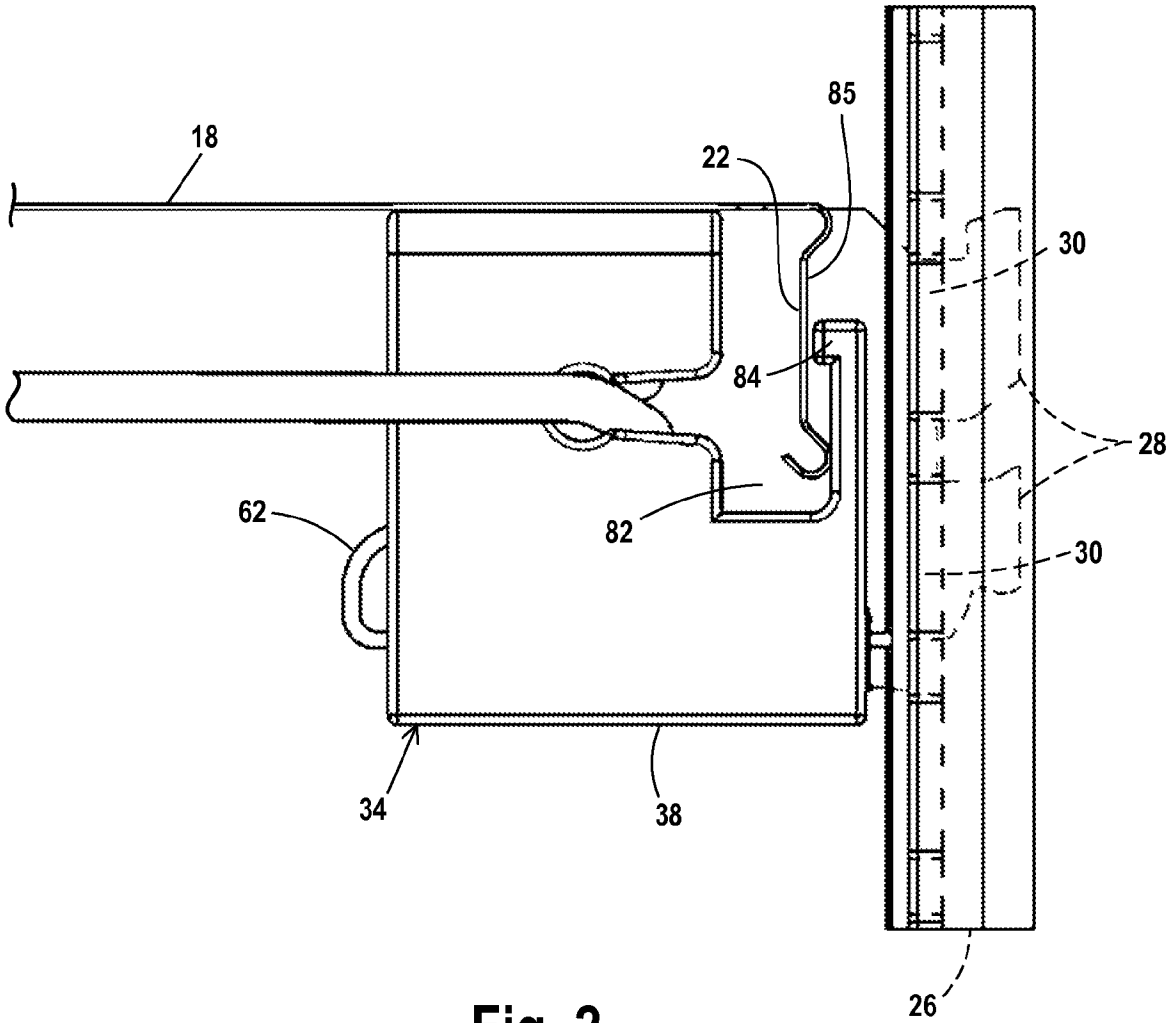
FIG. 2 is a side view of an end of a shelf without a mounting bracket and a mounting strip on the wall, taken along line 2-2 of FIG. 1.

Power units are mounted on the bottoms of shelves 16 as illustrated in FIG. 2. The magnet or magnets hold the units against the bottom of the shelf with wall 80 behind lip 22 and projection 84 extending into recess 85. The power unit overlies strip 32. Contacts 60 engage the conductors 110 in the power strip. Springs 70 hold the contacts against the strips. The wall 80 engages the inner shelf lip 22 to prevent the springs from moving unit 34 away from the power strip and reducing contact pressure between the pins and the strip conductors 110.

Power unit 34 is held against the bottom of shelf 16 by a magnet or magnets 54. If desired, other types of fasteners may be used to mount the power unit on the shelf, including adhesive fasteners, mechanical fasteners including threaded fasteners, hooks and the like.

Magnetic fasteners are desirable because of the ease of mounting the power units on the shelves and the ability to mount the power units on the shelves without disturbing the upper surface of the support platform 18. The magnetic fasteners permit easy, rapid mounting of the units and equally easy and rapid removal of the unit from the shelf, if desired. Other types of fasteners, including adhesive and screw-type fasteners, may be used, if desired.

What we claim as our invention is:

1. A shelf lighting connector assembly for forming electrical connections between a power strip and a light on a shelf having a lip, the assembly comprising: a body, a wall on the body, a slot between the wall and the body, two side-by-side recesses in the body; two slide members, each slide member in a recess, a metal contact on each slide member, a coil spring biasing each slide member outwardly of the body to hold a metal contact against a power strip, a power cable comprising leads, the cable connected to the metal contacts and to a plug for establishing a power connection to a light on the shelf, the leads extending through the springs, and a magnetic or adhesive fastener to mount the body to the underside of the shelf, wherein when the assembly is mounted on the shelf by the fastener with a shelf lip in the slot, the wall prevents movement of the assembly away from the power strip and the springs hold the metal contacts against the power strip.

2. The assembly as in claim 1 wherein each slide member includes a retention member engaging the body.

3. The assembly as in claim 1 wherein each retention member comprises a latch retaining a slide member in a recess.

4. The assembly as in claim 1 wherein an end of each spring is secured in a slide member.

5. The assembly as in claim 1 wherein the slot opens at the top of the body.

6. The assembly as in claim 1 wherein the body includes a groove, the cable in the groove.

7. The assembly as in claim 1 wherein said contact body includes a U-shaped member above the recesses, said U-shaped member forming one side of the slot, said fastener on the top of the U-shaped member.

8. The assembly as in claim 7 wherein said U-shaped member includes a first cable retention groove, said cable in said groove.

9. The assembly as in claim 8 wherein the groove opens into the slot.

10. The assembly as in claim 8 including a second retention groove and wherein the U-shaped member includes two sidewalls, one groove in each sidewall.

11. A shelf lighting assembly for forming electrical connections between conductors on a wall and a light on a shelf mounted on a wall, the assembly comprising: a molded plastic body having two channels, a slide body in each channel, a contact in each slide body, each contact facing outwardly of the plastic body, a power cable having two leads, each lead connected to a contact, an end conductor on the power cable, a latch retaining each slide body in a channel, a coil spring in each channel biasing the slide body and contact outwardly of the body, a wall on the body, a slot between the wall and the body, the body including a mounting member for engaging the underside of a shelf, a magnet or adhesive fastener on the mounting member to magnetically or adhesively hold the body on the underside of the shelf, an opening under the mounting member, a cable retention member on said body adjacent said opening, the power cable on one side of the body and engaging the cable retention member, the leads extending from the cable through the opening and joining the contacts in the slide bodies, each lead extending through a spring.

12. The shelf lighting assembly as in claim 11 wherein the body includes two walls to either side of the opening and the cable retention member comprises a groove at the slot, the cable in the groove.

13. A shelf lighting connector assembly for forming electrical connections between a power strip and a light on a shelf having a lip, the assembly comprising: a body, a wall on the body, a slot between the wall and the body, two metal contacts in the body, a power cable connected to the metal contacts and to a plug for establishing a power connection to a light on the shelf, the cable comprising two leads with each lead extending through a coil spring, and a fastener to mount the body to the shelf, wherein when the assembly is mounted on the shelf by the fastener with a shelf lip in the slot, the wall prevents movement of the assembly away from the power strip and the metal contacts engage the power strip.

14. The assembly as in claim 13 wherein the fastener comprises a magnet.

15. The assembly as in claim 14 wherein said contact body includes a U-shaped member above the contacts, said U-shaped member forming one side of the slot, said fastener on the top of the U-shaped member.

16. The assembly as in claim 15 wherein said U-shaped member includes a first cable retention groove, said cable in said groove.

17. The assembly as in claim 16 wherein the groove opens into the slot.

18. The assembly as in claim 16 including a second retention groove and wherein the U-shaped member includes two sidewalls, one groove in each sidewall.

* * * * *

UNITED STATES PATENT AND TRADEMARK OFFICE

CERTIFICATE OF CORRECTION

PATENT NO. : 8,986,039 B2
APPLICATION NO. : 14/018541
DATED : March 24, 2015
INVENTOR(S) : Harlan et al.

It is certified that error appears in the above-identified patent and that said Letters Patent is hereby corrected as shown below:

In the Specification:

Column 2, Line 36, replace “assemblies 78” with --bodies 56--.

Signed and Sealed this
First Day of September, 2015

Michelle K. Lee

Michelle K. Lee
*Director of the United States Patent and Trademark Office*